United States Patent [19]

Weyde et al.

[11] 4,401,751

[45] Aug. 30, 1983

[54] SILVER SALT EMULSION, PHOTOGRAPHIC MATERIAL AND PROCESS FOR THE PRODUCTION OF PHOTOGRAPHIC IMAGES

[75] Inventors: Edith Weyde, Kuerten; Harald von Rintelen, Leverkusen; Wilhelm Saleck, Bergisch Gladbach; Heinz-Horst Teitscheid, Leverkusen, all of Fed. Rep. of Germany

[73] Assignee: Agfa-Gevaert Aktiengesellschaft, Leverkusen, Fed. Rep. of Germany

[21] Appl. No.: 306,221

[22] Filed: Sep. 28, 1981

[30] Foreign Application Priority Data

Oct. 3, 1980 [DE] Fed. Rep. of Germany ..... 3037384

[51] Int. Cl.[3] ..... G03C 5/26; G03C 5/24

[52] U.S. Cl. ..... 430/375; 430/377; 430/550; 430/551; 430/432; 430/444; 430/448; 430/599; 430/609; 430/634; 430/635; 430/290; 430/943

[58] Field of Search ..... 430/635, 634, 943, 599, 430/609, 550, 551, 290, 377, 567, 432, 434, 375, 444, 448; 260/47 UA

[56] References Cited

U.S. PATENT DOCUMENTS

| | | | |
|---|---|---|---|
| 3,765,090 | 10/1973 | Weyde et al. | 430/943 |
| 4,012,362 | 3/1977 | Reiff et al. | 260/47 UA |
| 4,260,674 | 4/1981 | Weyde et al. | 430/943 |

*Primary Examiner*—Won H. Louie, Jr.
*Attorney, Agent, or Firm*—Connolly and Hutz

[57] ABSTRACT

Silver halide emulsions, which have been precipitated in the presence of polymers having recurring units with a 8-hydroxy quinoline structure are suitable for the preparation of vesicular images.

12 Claims, No Drawings

SILVER SALT EMULSION, PHOTOGRAPHIC MATERIAL AND PROCESS FOR THE PRODUCTION OF PHOTOGRAPHIC IMAGES

This invention relates to a silver salt emulsion and to a photographic material for a process for the production of photographic images by imagewise exposure of a light-sensitive layer containing a silver salt and decomposition of peroxide compounds at the image nuclei produced on exposure, the image being capable of being rendered visible either physically by development of the gas vesicles formed in the process of decomposition or chemically by utilising the oxygen formed on decomposition for an oxidizing reaction which produces colour. The invention also relates to a process for the production of photographic images.

The production of photographic images by the imagewise production of gas vesicles is known. U.S. Pat. No. 3,615,491 describes a process for the production of photographic images consisting of a silver image and a vesicular image superimposed on the silver image.

In the said process, a silver image is first produced in the conventional manner in a hydrophilic layer but this image has considerably less covering power than the conventional black-and-white image. The layer is then brought into contact with hydrogen peroxide, and in the areas which contain the silver in a finely divided form in imagewise distribution, the hydrogen peroxide is decomposed to form vesicle of oxygen gas. When the exposed material is subsequently heated, the gas which has been liberated expands and a vesicular image is formed. Since the vesicles scatter the light imagewise, these areas appear dark by transmitted light but light in front of a dark background when viewed by reflected light.

Most of the incident light in the unexposed areas of the layer is transmitted, with the result that the silver image is very powerfully reinforced and deep black images with high contrast can be seen by transmitted light, even in layers which have a very low silver content. The quality of photographic images obtained by this process is excellent.

It is also known that the oxygen which has been released by imagewise decomposition of hydrogen peroxide may be rendered visible not only by the physical means of the formation of vesicles as described above but, instead, by chemical means of utilising the oxygen for an oxidizing reaction by which colour is produced. In this process, a light-sensitive layer is exposed to give rise to the imagewise production of nuclei of noble metals of sub-Groups I and VIII of the Periodic System, and this layer is then treated with peroxy compounds which are decomposed catalytically in contact with the nuclei which have been produced imagewise, this treatment with peroxy compounds being carried out in the presence of the reactants for an oxidizing reaction which produces colour.

German Offenlegungsschrift No. 2,418,997, British Pat. No. 1,510,470 and U.S. Pat. Nos. 4,065,312 and 4,260,674 disclose a photographic material for a dry method of producing photographic images by imagewise exposure of a light-sensitive layer, which may be either self-supporting or applied to a layer support. Dispersed in this light-sensitive layer are light-sensitive silver salts which, when exposed to light, form catalysts for the decomposition of peroxide compounds. The exposed layer is subsequently treated with a peroxide compound to form a visible image. The light-sensitive layer contains the silver salt in quantities of from 1 to 500 mg/m$^2$. Before the layer is cast, the silver salt dispersion has a $p_{Ag}$-value below the equivalence point. The particle size of the silver salt grains is less than 0.3 μm and the transparency of the photographic material is at least 80%.

The process described above gives rise to very sharp images with minimal graininess, but the speed of the material is low because it cannot be increased by the usual method of using more coarsely grained silver halide emulsions since these would no longer be capable of decomposing $H_2O_2$ as described.

It is known from various publications that gelatin, in whose presence the silver halide for photographic purposes is normally precipitated, may be partly or completely replaced by synthetic polymers. References may be found in the following Patents: U.S. Pat. Nos. 3,813,251; 3,957,492; 3,748,143; 3,860,428; 2,614,928; 2,811,494; 4,089,688; British Pat. Nos. 1,485,057 and 1,365,489 and German Pat. No. 1,904,147.

It is found, however, that the peptizing agents described in the above mentioned publications are generally not suitable for the precipitation of silver halide emulsions if these emulsions are required to catalyse the decomposition of compounds, in particular of peroxide compounds, after exposure. When the peroxide used is $H_2O_2$, the formation of vesicles is in some cases suppressed completely while in other cases vesicles may be formed even in the unexposed areas, so that fogging occurs.

It is an object of the present invention to provide more highly sensitive silver salt emulsions. It is a particular aim of the invention to provide more highly sensitive silver salt emulsions which are suitable for a material in which an image is produced by the decomposition of peroxide compounds.

The following have now been found:

1. A light-sensitive silver salt emulsion having an average grain size of at the most 0.3 μm, prepared in the presence of a copolymer having recurrent units corresponding to the following formula:

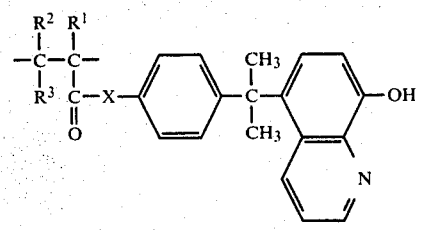

wherein

X denotes —O— or —NH—;

$R^1$ denotes hydrogen or alkyl with 1 to 4 C-atoms, preferably methyl;

$R^2$ denotes hydrogen or alkyl with 1 to 4 C-atoms, preferably methyl;

$R^3$ denotes hydrogen, —COOH or —COOR$^4$; and $R^4$ denotes alkyl with 1 to 8 C-atoms, e.g. methyl, n-butyl, n-octyl, or cycloalkyl such as cyclohexyl.

2. A photographic material comprising at least one light-sensitive layer and optionally other layers, for a process for the production of photographic images by imagewise exposure of a light-sensitive layer which may be either self-supporting or applied to a layer support, which light-sensitive layer contains at least one light-sensitive silver salt which on exposure forms a catalyst for the decomposition of peroxide compounds, followed by treatment of the exposed layer with a peroxide compound to form a visible image.

According to the invention, the photographic material contains at least one light-sensitive silver salt emulsion of the type described under 1.

3. A process for the production of photographic images by imagewise exposure of the material described under 2. above and treatment with a peroxide, optionally with the aid of at least one heat treatment and/or one development with a photographic developer.

It is surprisingly found that the copolymers used according to the invention, which have an 8-hydroxyquinoline structure, are particularly suitable for the decomposition of peroxide compounds in photographic materials.

The proportion of the 8-hydroxyquinoline structure in the copolymer may be from 0.1 to 20% by weight and is preferably from 0.1 to 10% by weight.

The comonomers to be considered for this purpose are primarily water-soluble compounds, e.g. polymerisable compounds having carboxylic acid, sulphonic acid or phosphonic acid groups, e.g. acrylic acid, methacrylic acid, vinylsulphonic acid, styrene sulphonic acid, allyl sulphonic acid, methallyl sulphonic acid, acrylamido-2-methyl-propane sulphonic acid and salts of the above mentioned acids, as well as vinyl pyridine, vinyl methyl ether, acrylamide and methacrylamide.

It may in some cases also be advantageous to incorporate limited quantities, e.g. up to 20 mol %, of polymerisable monomers which are less readily water-soluble, for the purpose of achieving certain effects such as elasticity and particular swelling characteristics. Examples of such monomers include acrylonitrile, acrylic acid esters and N-substituted acrylamides and methacrylamides.

The molecular weight of the homopolymers and copolymers used according to the invention is generally within the range of about from 10,000 to 1,000,000. If the molecular weight is too low, the viscosity of the emulsion will also be too low at the stage of preparation and its effect as protective colloid will generally be unsatisfactory. On the other hand, if the molecular weight is too high, the emulsion may be insufficiently compatible with other binders, e.g. gelatin. It is particularly preferred to use a polymer having a molecular weight of from 50,000 to 500,000.

Copolymers which, in addition to the structural units of the formula indicated above, contain structural units obtained by copolymerisation with acrylamide, acrylic acid and/or N-vinylpyrrolidone have proved to be particularly useful.

A method for the preparation of the monomers and of the copolymers has been described in German Offenlegungsschrift No. 2,407,307.

It has surprisingly been found that, in particular, those compounds which are to be used as peptising agents according to the invention are capable of substantially reducing the tendency of the materials according to the invention to fog and are capable of increasing the speed by 1 to 2 shutter stops.

The peptising agents used according to the invention must be present at the time of precipitation of the silver salt. According to a preferred embodiment of the invention, the aqueous solution of the polymers to be used according to the invention is introduced into the empty reaction vessel, and the silver salt may then be precipitated in this aqueous solution in known manner. Alternatively, however, the compounds to be used according to the invention may also be added to a starting solution, e.g. a halide or silver nitrate solution. The quantity added depends on the desired effect and can be determined in the usual manner by a few simple tests. Depending on the desired average grain size, the concentration of the polymers to be used according to the invention may be from 0.05 to 20% by weight, in particular from 0.6 to 6% by weight, at the time of precipitation, this percentage being based on the quantity of substance originally present in the reaction vessel. The peptising agent used for precipitation may be a compound according to the invention alone or a mixture thereof with other peptising agents. The additional compounds used may be natural or synthetic hydrophilic or hydrophobic film-forming polymers.

Examples include proteins such as gelatin, in particular photographically inert gelatin, cellulose derivatives such as cellulose esters or ethers, e.g. cellulose sulphate, carboxymethylcellulose or cellulose acetates, in particular those cellulose acetates which have a degree of acetylation of up to 2, and synthetic polymers such as polyvinyl alcohols, partially saponified polyvinyl esters, e.g. partially saponified polyvinyl acetate, and polyvinyl pyrrolidone.

In particular, it may be suitable to prepare a mixture with gelatin. The proportions of the mixture may vary within the widest limits, but a proportion of polymer used according to the invention to gelatin within the range of from 1:7 to 1:1 is particularly suitable.

According to a preferred embodiment, very fine grained emulsions may be obtained by precipitating with dilute silver nitrate and halide solutions (e.g. 1% solutions) at a very low temperature. Precipitation may also be carried out at higher temperatures, in particular when the process described in German Pat. No. 1,472,745 is employed. In the simplest case, the halide solution is tipped into the solution of polymer I, and addition of the silver nitrate solution then follows immediately. Gelatin may then be added, and the emulsion cooled and solidified.

The $p_{Ag}$ range to be observed when precipitating the silver salt, in particular a silver halide, in the presence of polymers of formula (I) is not critical but is preferably within the range of from 6 to 10. The pH range in the precipitating medium may in particular be from 2 to 7. Especially satisfactory results are obtained at pH values of from 3 to 5.

The silver salt emulsion obtained may be washed after precipitation, although this step is not necessary in view of the small amount of silver used in the materials according to the invention. The light-sensitive halide layers in the materials according to the invention have a very low silver content (expressed as silver nitrate), generally amounting to only 1 to 800 mg per $m^2$, preferably 100 to 400 mg per $m^2$. The thickness of the light-sensitive layer is preferably from 0.5 to 15 μm, in particular from 2 to 10 μm.

Some examples for the preparation of the polymers used according to the invention now follow.

Polymer 1

5 ml of a 20% sodium hydroxide solution are slowly added with stirring to a solution of
4 g of 2-[4-methacryloyloxyphenyl]-2-[5-(8-hydroxyquinolyl)]-propane in
40 ml of alcohol.

4 g of freshly distilled acrylic acid and a solution of
88 g of acrylamide in 200 ml of water/alcohol (1:1) are then added. The reaction mixture is vigorously flushed with nitrogen, and a solution of
0.7 g of potassium persulphate in the smallest possible quantity of water is added. The reaction mixture is then stirred for 3 hours at 80° C. After cooling, the upper phase is poured off and the precipitated product is purified by repeatedly dissolving it with sodium hydroxide solution and precipitating with acetic acid. The purified product is used to prepare a solution in water having a solids content of 13.5%. In an alkaline medium, this aqueous solution has the intense yellow colour of the oxinate anion.

Polymer 2

A copolymer of
2 g of 2-[4-methacryloyloxyphenyl]-2-[5-(8-hydroxyquinolyl)]-propane,
4 g of acrylic acid and
88 g of acrylamide is prepared similarly.

Polymer 3

A copolymer of
1 g of 2-[4-methacryloyloxyphenyl]-3-[5-(8-hydroxyquinolyl)]-propane
4 g of acrylic acid and
88 g of acrylamide is prepared similarly.

Polymer 4

110.5 g of acrylic acid amide,
7.10 g of N-vinylpyrrolidone and
2.4 g of 2-[4-methacryloyloxyphenyl]-2-[5-(8-hydroxyquinolyl)]-propane are dissolved in
360 g of ethanol at 70° C., and to this solution is added dropwise in the course of 3 hours a solution of
5.76 g of a 50% benzoyl peroxide paste in
100 ml of benzene. The reaction is left to continue for 20 minutes, and the white polymer formed in the reaction is filtered off.
Yield: 126 g Polymer 5

A terpolymer of
108.8 g of acrylic acid amide,
7.0 g of N-vinylpyrrolidone and
4.2 g of 2-[4-methacryloyloxyphenyl]-2-[5-(8-hydroxyquinolyl]-propane is prepared by a method analogous to that of Example 4.

Polymer 6

A terpolymer is prepared by a method analogous to that of Example 4 from
107.2 g of acrylic acid amide,
7.8 g of N-vinylpyrrolidone and
6 g of 2-[4-methacryloyloxyphenyl]-2-[5-(8-hydroxyquinolyl]-propane.

The average size of the silver salt grains in the light-sensitive layers of the material according to the invention is relatively small. It should be at the most 0.3 μm and is preferably less than 0.1 μm. It is particularly suitable to use silver salt dispersions having a relatively narrow range of grain size, with the maximum at about 0.1 μm. According to a preferred embodiment, at least 50% of the grains have a maximum size of 0.3 μm.

The transparency of the materials according to the invention should be at least 80%. This means that the material according to the invention should not absorb more than 20% of the visible light, and as standard for comparison of the transparency there is used a sheet of material having the same structure and same composition as the material to be tested but without containing any silver salts or other additives.

The transparent layer supports commonly used for photographic materials are suitable for the material according to the invention. These include, for example, foils of cellulose esters and of polyesters based on polyethylene terephthalic acid esters or polycarbonates, in particular those based on bisphenol A. When choosing suitable layer supports, it is, of course, necessary to ensure that they are stable at the temperatures employed for processing.

The light-sensitive silver salts used for the material according to the invention may be, for example, silver halides such as silver chloride, silver bromide or mixtures thereof, optionally with a molar silver iodide content of preferably up to 10%. Silver halides are used for preference on account of their relatively high intrinsic sensitivity.

The material according to the invention may in principle be used in any known processes for the production of photographic images by the imagewise decomposition of peroxide compounds. These include processes in which the decomposition of a peroxide compound takes place on relatively coarse nuclei of metallic silver formed after exposure and photographic development. The material according to the invention is, however, particularly suitable for a process in which imagewise exposure is followed by a first heat treatment, preferably in the presence of a reducing agent, before the treatment with a peroxide which is to be decomposed. This is carried out by simply heating to temperatures preferably in the range of from 80° to 130° C. The time of heating may vary within wide limits and is generally from 2 to 30 seconds.

The material may contain a reducing agent incorporated in the light-sensitive layer or in an adjacent layer.

Treatment of the material according to the invention with a peroxide compound may be carried out in known manner.

The simplest method consists of bringing the exposed layer into contact with vapours of a peroxide compound with heating. The most suitable peroxides are hydrogen peroxides and compounds which liberate hydrogen peroxide when heated, e.g. percarbamide and the materials mentioned in German Offenlegungsschrift No. 2,420,521.

According to a preferred embodiment, the exposed layer is brought into contact with a sheet of material containing hydrogen peroxide or addition products thereof. The layer is then heated in contact with the material, so that hydrogen peroxide is transferred from the sheet to the layer containing the silver salt dispersion. A vesicular image is thereby formed in the layer of silver salt dispersion or, if the layer of silver salt dispersion contains reactions for an oxidizing reaction producing dyes, a visible dye image is obtained.

The two possibilities of producing visible images by imagewise decomposition of peroxide compounds are described in U.S. Pat. Nos. 3,615,491 and 3,674,490.

Peroxide-containing layers used according to the preferred embodiment indicated above are described in U.S. Pat. No. 3,765,890.

The materials according to the invention may contain known antioxidants to improve their stability in storage, e.g. alkali metal sulphites, bisulphite addition products of aldehydes and ketones or, preferably, cycloalkyl ketones, in particular cyclohexanone bisulphite.

The silver salt dispersions may also be chemically sensitized, e.g. with reducing agents such as tin-II salts, polyamines such as diethylene triamine, sulphur compounds as described in U.S. Pat. No. 1,574,944 or in the book by MEES "Theory of the Photographic Process" (1954), pages 149 to 161. Salts of noble metals such as ruthenium, rhodium, palladium, iridium, platinum or gold may also be used to sensitize the given emulsions chemically, as described in the article by R. KOSLOWSKY, Z. Wiss. Phot. 46 (1951), pages 65 to 72. Compounds of the thiomorpholine series, e.g. those described in French Pat. No. 1,506,230, are also suitable for this purpose, as well as polyalkylene oxides, in particular polyethylene oxide and derivatives thereof.

The silver salt dispersions may also be optically sensitized, e.g. with the usual polymethine dyes such as neutrocyanines, basic or acid carbocyanines, mero- or rhodacyanines, hemicyanines, styryl dyes, oxonoles and the like. Sensitizers of this type have been described in the work by F. M. HAMER "The Cyanine Dyes and Related Compounds" (1964).

Where the binders used for the dispersion of the silver salts are capable of hardening, they may be hardened by the usual methods, for example, with formaldehyde or halogen-substituted aldehydes containing a carboxyl group, such as mucobromic acid, diketones, methanesulphonic acid esters, dialdehydes and the like. Instant hardeners are particularly simple to handle.

Known compounds capable of acting as halogen acceptors may be added to the materials according to the invention to improve the stability of the imge nuclei and the sensitivity to light. Examples of such halogen acceptors include silver salts, reducing agents and developer substances. The latter serve the additional function of developer substances during the heat treatment of the exposed material.

The positive action of such compounds is based on their trapping the halogen released in the primary action on exposure to light. The compounds thereby prevent destruction of the latent silver image nuclei by the halogen.

The following silver salts are examples of suitable compounds for this purpose:

Silver oxalate,
silver phosphate,
silver-(3-carboxylatomethylthio)-1,2,4-triazole,
silver-(3-carboxylatomethylthio)-5-amino-1,2,4-triazole,
silver-(2-carboxylatomethylthio)-5-amino-1,3,4-thiadiazole,
silver-(2-carboxylatomethylthio)-5-anilino-1,3,4-thiadiazole,
silver-(2-carboxylatomethylthio)-benzimidazole,
di-silver-[3,5-bis-(carboxylatomethylthio)]-1,2,4-triazole,
N-(N-tosyl-N'-phenylurea)-silver,
N-(N-3-amino-4-hydroxybenzoylsulphonyl-N-benzenesulphonimide)-silver,
N-(1,2-benzisothiazolyl-3-one)-silver,
silver-(2-carboxymethylthio-4-methyl)-quinoline,
di-silver-(1,2-bis-carboxylatomethylthio)-ethane,
N-benzotriazolyl-silver, and
silver salts of the following compounds:

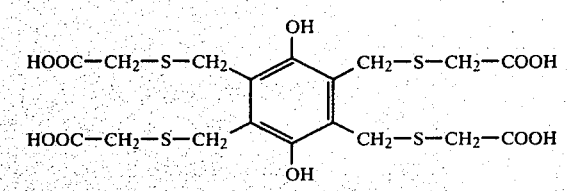

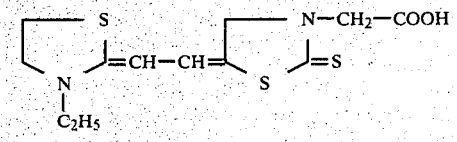

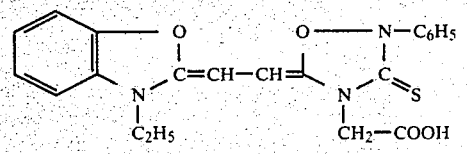

A stabilizing action and therefore an improvement in the light-sensitivity is also obtained by using reducing agents such as hydrazines and their derivatives, substituted hydrazines and acylated hydrazines, in particular hydrazides, as well as aminophenols, aminosubstituted benzene compounds, in particular phenylene diamine, and substitution products thereof, e.g. the following compounds:

Hydrazides

Tartaric acid dihydrazide, malonic acid dihydrazide, malic acid dihydrazide, mucic acid dihydrazide and citric acid trihydrazide.

Polyamines

Diethylene triamine.

Hydroxylamine derivatives

N-Ethyl-N'-hydroxyurea, N-phenyl-N'-hydroxyurea, N-hydroxyurea, N-hydroxybenzamide, and N-hydroxycarbamic acid ethyl ester.

Phenols

Pyrocatechol, hydroquinone, 1,4-dihydroxyphthalimide, DL-d-methyl-$\beta$-(3,4-dihydroxyphenylalanine), homogentisic acid, homogentisic acid amide, and 2,5-dihydroxyphenyl-5-(1-phenyltetrazolyl)-sulphide.

Phenylene diamines

N,N-Diethyl-N'-sulphomethyl-p-phenylenediamine, N,N-dimethyl-N'-sulphomethyl-p-phenylenediamine, and 3-methyl-4-sulphomethylamino-N,N-diethyleneaniline.

3-Pyrazolidones

1-Phenyl-3-pyrazolidone, 1-m-toluene-3-pyrazolidone, 1-p-tolyl-3-pyrazolidone, 1-phenyl-4-methyl-3-pyrazolidone, 1-phenyl-5-methyl-3-pyrazolidone, 1,4-dimethylpyrazolidone-3,4-methylpyrazolidone-3, 4,4-dimethylpyrazolidone-3,1-phenyl-2-acetyl-3-pyrazolidone, 1-phenyl-4,4-dimethyl-3-pyrazolidone, 1-(4-bromophenyl)-3-pyrazolidone, 1-p-tolyl-4-hydroxymethyl-4-methyl-3-pyrazolidone, 1-phenyl-4-hydroxymethyl-4-methyl-3-pyrazolidone.

The compounds mentioned above are added to the photographic layer before it is cast. Their concentration may vary within wide limits, depending on the activity of the compound and the purpose for which it is required. Concentrations of 10 to 500 mg/m$^2$ of material, have generally been found suitable. Hydrazines and hydrazides are particularly used in concentrations of 10 to 200 mg/m$^2$.

The above mentioned compounds which improve the stability and light-sensitivity may also be used as mixtures with each other. Optimum combinations may easily be found with the aid of simple laboratory tests.

The photographic material may contain the usual colour couplers, which may be directly incorporated in the silver halide layers. Examples of suitable colour couplers may be found in the publication entitled "Farbkuppler" by W. PELZ in "Mitteilungen aus den Forschungslaboratorien der Agfa, Leverkusen/München", Volume III, (1961) and the publication by K. VENKATARAMAN in "The Chemistry of Synthetic Dyes", Vol. 4, 341 to 387 Academic Press, 1971.

2-Equivalent couplers may also be used, for example, the known DIR couplers. The colour couplers may be added to the light-sensitive silver halide emulsions or to other casting solutions by the usual, known methods.

If the couplers are insoluble in water or alkalies, they may be emulsified in known manner, if necessary adding so-called coupler solvents or oil formers; see also, for example, U.S. Pat. Nos. 2,322,027; 2,533,514; 3,689,271; 3,764,336 and 3,765,897.

The photographic materials may contain the usual stabilizers, e.g. tri- or tetraazaindolizines, and in particular those which are substituted with at least one hydroxyl and/or amino group. Examples of such indolizines have been described in the article by BIRR, Z. Wiss. Phot. 47 (1952), pages 2 to 58, and in U.S. Pat. No. 2,944,901. Benzotriazoles and heterocyclic mercapto compounds such as 3-mercapto-4-amino-1,2,4-triazole or 3-mercapto-4-(p-sulphonic acid phenylamino)-5-methyl-1,2,4-triazole may also be used.

For improving development in the heat development process, the photographic materials may contain the usual substances which split off water in the heat, or they may contain hydrophilic compounds which increase the residual moisture content of the layer. Substances of the first mentioned type include e.g. ureas, caprolactams, $\beta$-nitroethanols, $\beta$-cyanoethanols and salts which form clearly defined hydrates, such as sodium acetate, sodium citrate and sodium sulphate.

Polyalcohols and mono- and oligo-saccharides are substances of the second type. The advantage of the latter substances is that, in addition to the effect thereof in heat development described in German Pat. No. 1,174,157, they are oxidized to acids by hydrogen peroxide, thereby lowering the pH of the processed layers. The frequently observed discolouration of images by light is prevented by this lowering of the pH by the acids formed, e.g. saccharic acids.

The photographic materials according to the invention are distinguished by being virtually free from any problems of fogging. When using conventional photographic materials and processing them in the usual manner by photographic development of the exposed material, it is necessary to suprress as far as possible the uniform fog which tends to develop spontaneously in the unexposed material, whereas in the material according to the invention the photographic process does not give rise to the uniform fog which in conventional photographic materials would be sufficiently dense virtually to exclude their use in practice.

Preparation of the photographic material according to the invention is therefore much simpler and less expensive. The materials according to the invention give rise to photographic images with a relatively steep gradation. They are therefore particularly suitable for use as copying films, in particular as microfilms for archive purposes, but they may also be used for a wide variety of other purposes, and are particularly suitable e.g. for all purposes in computers.

The following Examples illustrate the invention. Percentages are by weight unless otherwise indicated.

EXAMPLE 1

Comparison material

According to example 1 of U.S. Pat. No. 4,065,312 a mixture of 250 ml of a 10% aqueous solution of inert gelatin and 50 ml of a 2% aqueous solution of silver nitrate is introduced into the reaction vessel and 10 ml of a 5% aqueous solution of potassium bromide are added dropwise. The emulsion is solidified in the usual manner. It has a $p_{Ag}$ of 3.75. The silver bromide grains have an average diameter of 0.015 $\mu$m.

Before the emulsion is cast, 2.5 ml of a 30% aqueous saponin solution and 15 ml of a 10% aqueous solution of 1-phenyl-3-pyrazolidone are added and the pH is adjusted to 5.7 to 5.8 with borax.

The emulsion is applied to a layer support of cellulose triacetate to form a silver concentration of 0.3 g in the form of silver halide per m$^2$. After drying at 28° C., the photographic material has a transparency of 90%. It is exposed and then heated in a heating press at 100° C. for about 5 seconds. After this treatment, the film is heated to a temperature of about 100° C. in close contact with a foil containing $H_2O_2$ by means of a heating press.

The foil is obtained by coating a cellulose acetate film with a solution of polyvinyl alcohol or carboxymethyl cellulose with the addition of hydrogen peroxide. The foil contains about 2 to 6 g $H_2O_2$/m$^2$.

Material according to the invention

A 0.1% inert gelatin solution containing the quantity of polymer according to the invention indicated in Table 1 below is introduced into a reaction vessel. At 40° C., a 0,2% aqueous silver nitrate solution is tipped in with vigorous stirring, immediately followed by a 0.17% aqueous potassium bromide solution. The quantity of potassium bromide is calculated to adjust the $p_{Ag}$ to 9. A 10% gelatin solution is then added to solidify the emulsion. The emulsion is then processed, exposed and developed in the same manner as the comparison material, without being first washed or after-ripened. Table 1 shows that an unexpectedly high increase in speed is obtained by the compounds according to the invention without any fogging being produced.

TABLE 1

| Quantity of Polymer No. 4 (%) | | speed | Fog |
|---|---|---|---|
| Comparison | ./. | 100 | no fog |
| | 50 | 175 | " |
| | 75 | 200 | " |
| | 83 | 250 | " |
| | 97 | 225 | " |

The speed is given in relative values. Doubling the figure corresponds to a doubling of speed. The quantity of polymer according to the invention is based on the total quantity of peptising agent.

We claim:

1. A light-sensitive emulsion containing a silver salt capable of forming a catalyst for decomposition of a peroxide compound and in an amount in the range of from 1 to 800 mg/m$^2$ of the emulsion and having an average grain size of at the most 0.3 μm characterized in that said emulsion contains a copolymer having from 0.1 to 20% by weight of recurrent structural units corresponding to the following formula:

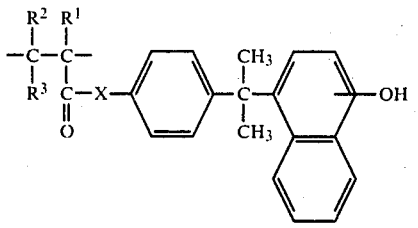

(I)

wherein

X denotes —O— or —NH—, $R^1$ denotes hydrogen or alkyl with 1 to 4 C-atoms, $R^2$ denotes hydrogen or alkyl with 1 to 4 C-atoms, $R^3$ denotes hydrogen, —COOH or $COOR^4$, and $R^4$ denotes alkyl with 1 to 8 C-atoms or cycloalkyl in an amount capable of reducing fog and increasing speed.

2. An emulsion according to claim 1 wherein the light-sensitive silver salt is a silver halide.

3. An emulsion according to claim 1 wherein from 0.1 to 20% by weight of the copolymer present at the time of precipitation consists of recurrent units of formula (I) and the remainder of the copolymer comprises copolymerised units of acrylamide, acrylic acid and/or N-vinyl pyrrolidone.

4. An emulsion according to claim 1 wherein the grain size of the silver salt grains is less than 0.1 μm.

5. A photographic material comprised of at least one light sensitive layer self-supporting or arranged on a layer support and optionally other layers for the production of photographic images by imagewise exposure and having at least one light sensitive emulsion containing a silver salt capable of forming a catalyst for the decomposition of a peroxide compound and in an amount in the range of from 1 to 800 mg/m$^2$ and having an average grain size of at the most 0.3 μm characterized in that said emulsion contains a copolymer having from 0.1 to 20% by weight of recurrent structural units corresponding to the following formula:

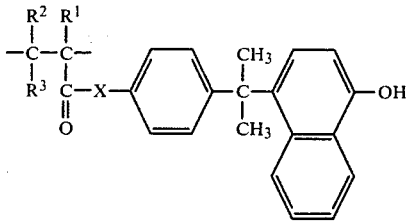

wherein

X denotes —O— or —NH—, $R^1$ denotes hydrogen or alkyl with 1 to 4 C-atoms;

$R^2$ denotes hydrogen or alkyl with 1 to 4 C-atoms;

$R^3$ denotes hydrogen, —COOH or $COOR^4$, and $R^4$ denotes alkyl with 1 to 8 C-atoms or cycloalkyl in an amount capable of reducing fog and increasing speed.

6. A material according to claim 5 wherein the photographic material has a transparency of at least 80%.

7. A material according to claim 5 wherein the light-sensitive layer or a layer adjacent thereto contains a reducing agent.

8. A process for the production of photographic images in a self-supporting or supported layer including the steps of imagewise exposing a layer which contains a light-sensitive emulsion containing silver salt capable of forming a catalyst for decomposition of a peroxide compound and in an amount in the range of from 1 to 800 mg/m$^2$ and having an average grain size of at the most 0.3 μm characterized in that said emulsion contains a copolymer having from 0.1 to 20% by weight of recurrent structural units corresponding to the following formula:

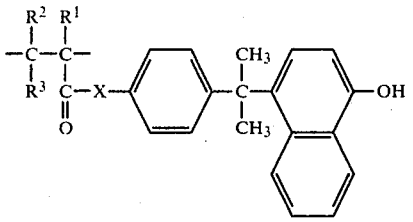

wherein

X denotes —O— or —NH—, $R^1$ denotes hydrogen or alkyl with 1 to 4 C-atoms $R^2$ denotes hydrogen or alkyl with 1 to 4 C-atoms $R^3$ denotes hydrogen, —COOH or $COOR^4$, and $R^4$ denotes alkyl with 1 to 8 C-atoms or cycloalkyl in an amount capable of reducing fog and increasing speed;

developing the exposed layer to form an image material therein, optionally with heat treatment, treating the said layer containing said image material with a peroxide compound capable of forming with said image material a visible product.

9. A process according to claim 8 wherein, between exposure and the treatment with a peroxide compound, the material is subjected to a heat treatment.

10. A process according to claim 8 wherein the peroxide compound is hydrogen peroxide.

11. A process according to claim 8 wherein the image is rendered visible by the formation of vesicles.

12. A process according to claim 8 wherein the image is rendered visible by a colour-producing reaction.

* * * * *